US008276223B1

(12) United States Patent
Connor

(10) Patent No.: US 8,276,223 B1
(45) **Date of Patent: *Oct. 2, 2012**

(54) SLEEPING ENCLOSURE WITH ASSURED VENTILATION

(75) Inventor: Robert A. Connor, Minneapolis, MN (US)

(73) Assignee: Medibotics, Forest Lake, MN (US)

( * ) Notice: Subject to any disclaimer, the term of this patent is extended or adjusted under 35 U.S.C. 154(b) by 319 days.

This patent is subject to a terminal disclaimer.

(21) Appl. No.: 12/584,694

(22) Filed: Sep. 10, 2009

(51) Int. Cl.

| | |
|---|---|
| ***A47C 27/00*** | (2006.01) |
| *A47C 27/08* | (2006.01) |
| *A47C 29/00* | (2006.01) |
| *E04H 15/02* | (2006.01) |
| *E04H 15/36* | (2006.01) |

(52) U.S. Cl. ..... 5/423; 5/424; 5/414; 135/96; 135/124

(58) Field of Classification Search ..... 5/423, 414, 5/424, 512, 513; 135/96, 124, 137, 116; 128/202.12; 600/21, 22

See application file for complete search history.

(56) References Cited

U.S. PATENT DOCUMENTS

| | | | | |
|---|---|---|---|---|
| 2,375,941 | A | | 5/1945 | Nostrand |
| 3,323,147 | A | | 6/1967 | Dean |
| 3,748,799 | A | | 7/1973 | Tough et al. |
| 4,017,917 | A | | 4/1977 | Brown |
| 4,079,162 | A | | 3/1978 | Metzger |
| 4,109,331 | A | | 8/1978 | Champeau |
| 4,129,123 | A | | 12/1978 | Smidak |
| 4,305,168 | A | | 12/1981 | Holter et al. |
| 4,377,195 | A | | 3/1983 | Weil |
| 4,513,041 | A | | 4/1985 | Delluc |
| 4,594,817 | A | | 6/1986 | McLaren et al. |
| 4,641,387 | A | | 2/1987 | Bondy et al. |
| 4,937,903 | A | | 7/1990 | Joly et al. |
| 5,018,328 | A | | 5/1991 | Cur et al. |
| 5,384,925 | A | | 1/1995 | Vail |
| 5,411,623 | A | | 5/1995 | Shutt |
| 5,560,058 | A | | 10/1996 | Smith |
| 5,669,088 | A | | 9/1997 | McNamee |
| 5,832,919 | A | * | 11/1998 | Kano et al. ..... 128/205.26 |
| 5,844,996 | A | | 12/1998 | Enzmann et al. |
| 5,867,957 | A | | 2/1999 | Holtrop |
| 5,896,710 | A | | 4/1999 | Hoyle |
| 6,014,345 | A | | 1/2000 | Schmadeka |
| 6,153,135 | A | | 11/2000 | Novitsky |
| 6,216,291 | B1 | | 4/2001 | Eads et al. |
| 6,263,529 | B1 | | 7/2001 | Chadwick et al. |
| 6,308,466 | B1 | | 10/2001 | Moriarty |
| 6,446,751 | B1 | | 9/2002 | Ahuja et al. |
| 6,461,290 | B1 | | 10/2002 | Reichman et al. |
| 6,487,735 | B1 | | 12/2002 | Jacques et al. |
| 6,508,850 | B1 | | 1/2003 | Kotliar |
| 6,694,547 | B1 | | 2/2004 | Vail |
| 6,772,458 | B2 | | 8/2004 | Ellen et al. |
| 6,827,760 | B2 | | 12/2004 | Kutt et al. |
| 7,047,991 | B2 | | 5/2006 | Kline |

(Continued)

*Primary Examiner* — Jonathan Liu

(57) ABSTRACT

There is a growing need for safe methods to insulate sleeping people from intrusive environmental noises so that they can get a decent night's sleep. This invention solves the problem of how to provide a sleeping enclosure with a high degree of insulation against environmental noises while also providing assured ventilation within the enclosure. It features an active ventilation means and a passive ventilation means that are physically linked so that there is always one of them providing ventilation. This linkage combines the superior sound-insulating properties of active ventilation (such as a longer air conduit for reduced intrusion of environmental noises into the enclosure) with the superior safety properties of passive ventilation (such as not being vulnerable to power failure or mechanical failure).

16 Claims, 3 Drawing Sheets

U.S. PATENT DOCUMENTS

| | | | | |
|---|---|---|---|---|
| 7,063,184 | B1 | 6/2006 | Johnson | |
| 7,380,296 | B2 | 6/2008 | Ellen et al. | |
| 7,434,280 | B2 | 10/2008 | Cyr | |
| 2005/0283913 | A1* | 12/2005 | Heaton et al. | 5/615 |
| 2006/0020159 | A1* | 1/2006 | Ellen | 600/21 |
| 2007/0125010 | A1 | 6/2007 | Papakonstantinou | |
| 2007/0294827 | A1 | 12/2007 | Carr et al. | |
| 2008/0276371 | A1* | 11/2008 | Stowers | 5/513 |
| 2009/0162599 | A1 | 6/2009 | Rickards | |

* cited by examiner

SLEEPING ENCLOSURE WITH ASSURED VENTILATION

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to sound-insulating enclosures in which people sleep and to assuring adequate ventilation within these enclosures.

2. Review of Related Art

Many people live in places that are increasingly noisy. The modern world is permeated by: intrusive sound systems with powerful bass speakers that penetrate apartment walls, video games with loud explosions and sound effects, vehicles with thumping bass speakers, jet and train traffic at all hours of the day and night, sirens and heavy equipment, dogs that bark incessantly, and so forth. The list of noise pollution sources grows each year. High noise levels are bad enough during daylight hours, but can be especially devastating at night when one is trying to sleep. Lack of sleep due to environmental noise can wreak havoc on one's health, productivity, and overall quality of life. Sleep-disturbing noise can even come from one's own household. For example, loud snoring can have devastating effects on one's closest personal relationships.

Some people can afford to live in places that are far removed from the flight paths of major airports, but other people can not. Some people can afford to live far away from establishments that play loud music until the early morning hours, but other people can not. Some people can afford to have living arrangements with multiple bedrooms so that they do not have to choose between a close relationship and getting enough sleep to face the next day, but other people can not. For many people, sleep deprivation is a vicious cycle. Sleep deprivation hinders them from earning more income, the limited income limits their living options, and the limited living options result in more sleep deprivation. What can be done to break this cycle to help people to get a decent night's sleep in today's increasingly noisy world?

For all of these reasons, there is a significant and growing need for safe methods to reduce exposure to intrusive sounds so that people can get a decent night's sleep. There are methods in the related art that reduce a sleeper's exposure to environmental sounds. However, as we will discuss, these methods in the related art have significant limitations. A very-real unmet need remains. The invention disclosed herein is designed to meet this need in an innovative, safe, and useful manner. There does not appear to be anything in the prior art that anticipates this invention. This invention can help many people to avoid the devastation of chronic sleep deprivation on their health, relationships, productivity and overall quality of life.

There are six main categories of methods in the related art for reducing a sleeper's exposure to environmental noise: (1) active noise cancellation and noise masking; (2) sound-insulating panels or blankets that are described apart from their use in a specific type of sleeping enclosure; (3) sound-insulating sleeping structures with no explicit means for providing ventilation; (4) sound-insulating sleeping enclosures with direct passive ventilation through openings or holes; (5) sound-insulating sleeping enclosures with passive ventilation through air-permeable surfaces such as screens or nets; and (6) sound-insulating sleeping enclosures with active ventilation means such as fans or air pumps. We now briefly discuss each of these methods and their limitations. We then discuss how this present invention addresses these limitations, providing a superior and innovative solution for creating a sound-insulating sleeping enclosure with assured ventilation.

1. Active Noise Cancellation and Noise Masking

This category of methods for reducing a sleeper's exposure to environmental noise involves active generation of sounds to cancel or mask the environmental noise. Some of the many examples in the related art that appear to use noise cancellation or noise masking include U.S. Pat. Nos. 5,844,996 (Enzmann et al., 1998), and 6,014,345 (Schmadeka, 2000).

Noise cancellation involves monitoring environmentally-intrusive noise and then custom-generating "noise-canceling" sounds that have a symmetrically-opposite wave structure. Ideally, when the environmentally-intrusive sound waves and the custom-generated sound waves meet and overlap, their acoustic energies cancel each other out because their wave patterns are symmetrically-opposite to each other. Although appealing in theory, such cancellation can be difficult to do well in practice. For example, generation of sounds in order to cancel the environmental noise is not instantaneous. The environmental noise must be detected and analyzed. This creates a lag between the two sounds. If the environmental noise is relatively continuous, then this lag need not be a problem. However, if the environmental noise is intermittent or highly-variable, then the lag is a problem. The lagged sound waves do not cancel each other out.

One solution to address the lag problem is to have the noise monitor be closer to the noise source than the speaker that emits the custom-generated sounds and the sleeper's ear. However, this solution to the lag problem only works if the environmental noise consistently comes from the same direction. This solution breaks down when environmental noise comes from different directions. Noise-cancellation headphones can come close to canceling noise from any direction. However, many people do not like to wear headphones when they sleep and even headphones do not completely eliminate the lag problem. For these reasons, active noise cancellation is not an ideal solution for reducing sleepers' exposure to environmental noise.

A related approach is "noise masking." Noise masking involves playing sounds that cover up, but do not cancel, intrusive environmental noise. Many noise masking devices create sounds with a broad-spectrum of frequencies, such as "white noise" or "pink noise," that cover up noise at random. Other noise masking devices offer a menu of sounds from which the sleeper can select to cover up particular environmental sounds.

Both types of noise masking have limitations. Broad-spectrum random sounds (such as "white noise" or "pink noise") may not be powerful or targeted enough to mask certain sounds, such as those with powerful bass frequencies. Sounds selected from a menu of sounds may have gaps between sounds or repetition in pre-recording sound loops that let the environmental sounds come through periodically or may themselves become annoying.

An overall limitation of using one sound to cover up another sound is analogous to using one smell to cover up another smell. Sometimes the sensory organ is just not fooled. For example, trying to cover up the smell of a wet dog with a flower scent might not fool one's nose. Trying to cover up a bass beat from the party next door with the sound of a bubbling waterfall might not fool one's ears. The combined effect can sometimes be doubly annoying, not relaxing.

2. Sound-Insulating Panels and Blankets Apart from a Specific Enclosure

This category of related art concerns sound-insulating panels and blankets. Such sound-insulating panels and blankets may be incorporated into various types of sound-insulating sleeping enclosures, but this art does not specify exactly how the panels and blankets are incorporated into particular designs of sound-insulating sleeping enclosures. Accordingly, related art in this category does not provide fully-developed methods of how to reduce a sleeper's exposure to external sounds. For example, this category of related art does not address how sound-insulating panels or blankets can be used to create a sound-insulating enclosure with assured ventilation. Nonetheless, it is worth noting this category for the sake of thoroughness and for the introduction of sound-insulating materials that may be used for sleeping enclosures.

Examples in the related art that appear to specify sound insulating panels or blankets apart from discussion of how they may be used in a specific enclosure for sleeping include the following: U.S. Pat. Nos. 4,513,041 (Delluc, 1985), 4,079,162 (Metzger, 1978), 3,748,799 (Tough et al., 1973), 5,018,328 (Cur et al., 1991), 5,411,623 (Shutt, 1995), 5,867,957 (Holtrop, 1999), 5,896,710 (Hoyle, 1999), 6,153,135 (Novitsky, 2000), and 7,063,184 (Johnson, 2006), and U.S. Patent Applications 20070125010 (Papakonstantinou, 2007) and 20090162599 (Rickards, 2009).

3. Sound-Insulating Structures with No Explicit Discussion of Ventilation

This category of methods for reducing a sleeper's exposure to external sounds involves partial enclosures that do not explicitly address how ventilation is provided. Generally, the degree to which they fully enclose the sleeper is sufficiently low that there remains plenty of passive ventilation from openings. Thus, explicit discussion of ventilation is not required. Some sound insulation is better than no sound insulation. Accordingly, these partial enclosures serve a purpose.

However, an opening that is sufficiently large to provide thorough passive ventilation is also sufficiently large to let a large amount of environmental sound energy reach the sleeper. For this reason, this category of sound-reducing means is not well-suited for thorough blocking of loud external sounds, particularly powerful bass sounds. Examples in the related art that appear to specify sound insulating structures with no explicit ventilation means include: U.S. Pat. Nos. 2,375,941 (Nostrand, 1945), 3,323,147 (Dean, 1967), 4,377,195 (Weil, 1983), 5,560,058 (Smith, 1996), and 6,446,751 (Ahuja et al., 2002).

4. Sound-Insulating Sleeping Enclosures with Ventilation Through Openings or Holes This category of methods for reducing a sleeper's exposure to external sounds involves sleeping enclosures with openings or holes that allow direct, passive ventilation of the enclosure. The advantages and disadvantages of these enclosures are similar to those with structures with no explicit discussion of ventilation means. Some sound insulation is better than no sound insulation, but openings or holes that are sufficiently large to provide complete passive ventilation are also sufficiently large to let a large amount of environmental sound energy reach the sleeper. This category of means is not well-suited for blocking loud external sounds, particularly powerful bass sounds. Examples in the related art that appear to specify sound-insulating sleeping enclosures with openings or holes for ventilation include: U.S. Pat. Nos. 4,017,917 (Brown, 1977), 4,305,168 (Holter et al., 1981), 4,594,817 (McLaren et al., 1986), 5,669,088 (McNamee, 1997), and 6,308,466 (Moriarty, 2001).

5. Sound-Insulating Sleeping Enclosures with Ventilation Through Screens

This category of methods for reducing a sleeper's exposure to environmental sounds involves sleeping enclosures with air-permeable surfaces on their walls. These air-permeable surfaces may include screens, nets, or meshes. These air-permeable surfaces provide passive ventilation of the enclosure. However, like enclosures with direct openings or holes, they do not do a good job of blocking loud external sounds, particularly powerful bass sounds.

Examples in the related art that appear to specify sound-insulating sleeping enclosures with air-permeable surfaces (such as screens or nets) for ventilation means include: U.S. Pat. Nos. 4,641,387 (Bondy et al., 1987), 5,384,925 (Vail, 1995), 6,216,291 (Eads et al., 2001), 6,263,529 (Chadwick et al., 2001), 6,487,735 (Jacques et al., 2002), 6,694,547 (Vail, 2004), 6,772,458 (Ellen et al., 2004), 7,047,991 (Kline, 2006), 7,380,296 (Ellen et al., 2008), and 7,434,280 (Cyr, 2008), and U.S. Patent Application 20070294827 (Carr et al., 2007).

6. Sound-Insulating Sleeping Enclosures with Active Ventilation Means

This category of methods for reducing a sleeper's exposure to external sounds involves sleeping enclosures with active ventilation means. Active ventilation means may include electric fans, air pumps, or other means of actively moving fresh air into the sleeping enclosure. The use of active ventilation allows the enclosure to more completely enclose the sleeper. Thus, it can provide more thorough insulation from environmental sounds than is possible with enclosures that rely on passive ventilation means such as openings, holes, screens, or nets. Examples in the related art that appear to specify sound-insulating sleeping enclosures with active ventilation means include: U.S. Pat. Nos. 4,109,331 (Champeau, 1978), 4,129,123 (Smidak, 1978), 4,937,903 (Joly et al., 1990), 6,461,290 (Reichman et al., 2002), 6,508,850 (Kotliar, 2003), and 6,827,760 (Kutt et al., 2004).

A sound-insulated sleeping enclosure with active ventilation means can be very thorough in reducing exposure of the sleeper to environmental sounds if the following criteria are met: (1) the enclosure completely surrounds the sleeper without substantive gaps to external airspace in the walls of the enclosure; (2) the walls of the enclosure contain a partial vacuum or a highly-effective sound-insulating material; (3) the conduit that brings fresh air into the enclosure from the active ventilation means is relatively long or otherwise designed to significantly dampen transmission of external sound through the conduit; and (4) the active ventilation means itself is relatively quiet, insulated, and/or some distance from the enclosure.

Although sleeping enclosures that rely solely on active ventilation means can have significant advantages over the other five methods of reducing a sleeper's exposure to environmental sounds that have just been discussed, reliance on active ventilation means has a significant disadvantage that has not yet been satisfactorily addressed in the related art. If the active ventilation means fails due to power failure or mechanical failure, then ventilation within the enclosure stops as well. This potential safety risk for the sleeper has not yet been resolved. Reliance on active ventilation alone provides the best sound insulation, but also has the risk of ventilation stopping due to power failure or mechanical failure.

To conclude—passive ventilation does not involve the risk of ventilation stopping, but provides relatively poor sound insulation. Active ventilation by itself can provide thorough sound insulation, but involves the risk of ventilation stopping. This fundamental safety dilemma has not yet been solved in the related art. It is solved in an innovative and useful manner by the invention disclosed herein.

SUMMARY OF THIS INVENTION

This invention solves the previously unsolved problem of how to provide a sleeping enclosure with a high degree of insulation against environmental sounds while also providing assured ventilation within the sleeping enclosure. The invention disclosed herein is a sound-insulating sleeping enclosure with ventilation safeguards. This sleeping enclosure features an active ventilation means and a passive ventilation means. These different ventilation means are physically linked so that there is always one of them providing ventilation. This linkage combines the superior sound-insulating properties of active ventilation (such as a longer air conduit for reduced intrusion of external sounds into the enclosure) with the superior safety properties of passive ventilation (such as not being vulnerable to power failure or mechanical failure).

A number of options can also be added to the basic invention. For example, the enclosure can be equipped with sound monitoring and ventilation control means such that the enclosure can switch from active to passive ventilation, or vice versa, based on environmental sound levels or types. As another option, the enclosure can be equipped with sound identification means to selectively transmit certain sounds that the sleeper does want to hear—such as important alarms, voices of family members, or other specifically-desired sounds. Characteristics of the environment within the enclosure that may also be optionally adjusted include: light level, light patterns, temperature level, humidity level, active noise masking, and soothing sounds or music.

INTRODUCTION TO THE DRAWINGS

These figures show different examples of how this invention may be embodied. However, these examples do not limit the full generalizability of the claims.

FIGS. 1 through 3 show side, top-down, and rectangular-end perspectives of an embodiment of this invention that contains a bed and has a ceiling formed by parallel inflatable members. FIGS. 1 through 3 show this embodiment when the active ventilation system is not operating, the inflatable members comprising the ceiling are uninflated, and there are gaps in the ceiling that allow passive ventilation.

DETAILED DESCRIPTION

These figures show different examples of how this invention may be embodied. However, these examples are not exhaustive. These figures do not limit the full generalizability of the claims.

Figure 1:
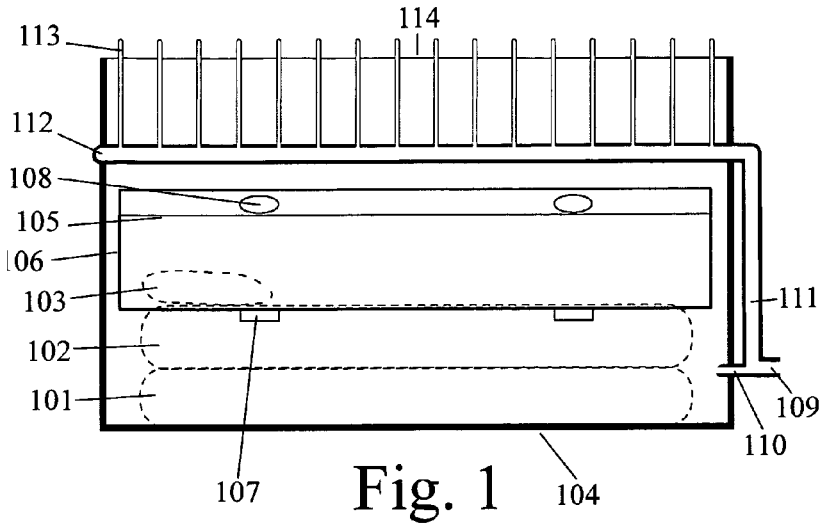
Figure 2:
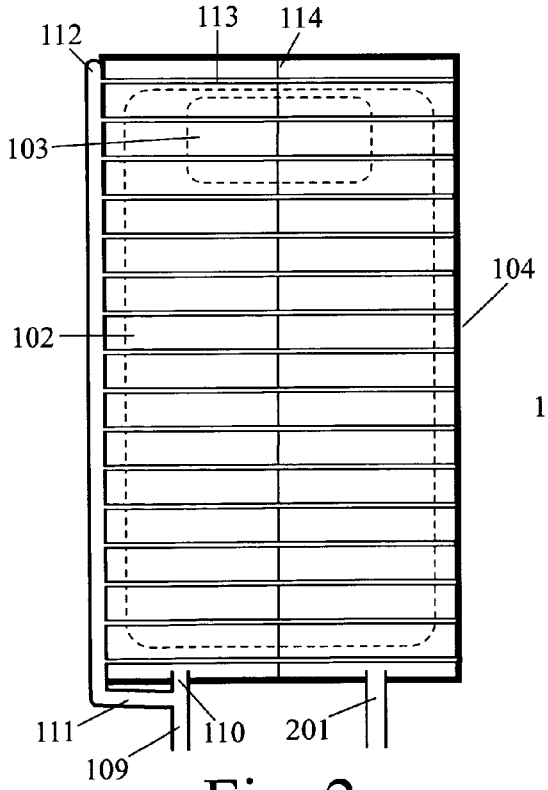
Figure 3:
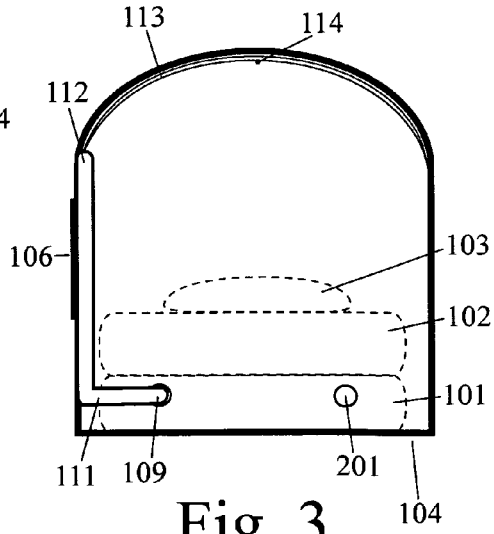

FIGS. 1 through 3 show three different views of one embodiment of this invention. This embodiment contains a bed, has a rectangular horizontal cross-section, and has a ceiling formed by parallel, arched, longitudinal inflatable members. The inflatable members of the ceiling have gaps between them when they are not inflated and do not have gaps between them they are inflated. FIGS. 1 through 3 show them when they are not inflated.

FIG. 1 shows a side view of this embodiment. The walls of the enclosure are transparent and there is no internal light source. In another example, the walls of the enclosure may be opaque and there may be an internal light source. This internal light source may be adjusted to create a light environment within the enclosure that is independent from the light environment outside the enclosure. The air conduits and inflatable members shown in FIG. 1 are shown in a cross-sectional (semi-transparent) perspective to highlight the continuity of passageways for air ventilation. In the actual physical embodiment of this invention, these conduits and inflatable members would likely be opaque.

FIG. 1 shows box spring 101, mattress 102, and pillow 103 within sound-insulating sleeping enclosure 104. Box spring 101, mattress 102, and pillow 103 are shown using dashed lines in this figure because they are not central to the invention, but they are useful for providing context. In another example, a sleeping bag, water bed, sleeping pad, or other surface for rest or relaxation could be within the enclosure instead of a regular bed.

In this example, the sleeping enclosure has a rectangular horizontal cross-sectional shape. In other examples, the sleeping enclosure may have a circular, oval, egg-shaped, octagonal, or other convex cross-sectional shape. In this example, the sleeping enclosure has an arched ceiling. In other examples, the sleeping enclosure may have a flat ceiling or a dome ceiling.

In this embodiment, sleeping enclosure 104 contains a single bed for one person. In another example, the sleeping enclosure may contain a queen-size bed for two people or it may contain two separate beds. In a variation on the version for two people, the sleeping enclosure may have a sliding panel that can optionally separate the air space between the two people. Such a sliding panel may be useful if one person snores, but both people still wish to sleep near each other. In a variation on the snoring example, the sliding panel may automatically and silently close to separate the airspace in response to snoring sounds during the night. In another example, a sliding panel may also be useful if one person is sick and might infect the other person by coughing during the night. In examples involving a sliding panel, there would be separate ventilation systems for each side of the airspace.

In this embodiment, the walls of the sound-insulating enclosure are transparent and the wall panels contain a partial vacuum to reduce sound transmission. In other examples, the walls of the sound-insulating enclosure may be opaque and contain synthetic or natural acoustic insulation material. Acoustic insulating materials can be selected from the group consisting of polymerics, polyolefins, polystyrenes, polyurethanes, olyethylenes, polyimides, neoprenes, other synthetic materials, mineral wool, textile fibers, wood fibers, and other natural fibers.

In the embodiment shown in FIG. 1, rectangular hole 105 in the side of enclosure 104 is a portal by which a sleeper enters or exits the sleeping enclosure 104. In this embodiment, rectangular hole 105 has a length that is slightly longer than mattress 102, has a height that is approximately two times the height of mattress 102, and has a bottom edge approximately the same height from the floor as the top of mattress 102. In FIG. 1, rectangular hole 105 is covered by a transparent, rectangular, sound-insulated side panel 106 that tilts on two hinges, including hinge 107. In FIGS. 1 through 3, side panel 106 is tilted upwards to cover rectangular hole 105. Later figures will show how side panel 106 looks when it is tilted downwards to uncover rectangular hole 105 in order to allow the sleeper to enter or exit enclosure 104.

Side panel 106 is slightly larger than rectangular hole 105 so that it overlaps with enclosure walls 104 in order to provide a sound-insulating seal and to allow hook-and-loop pad pairs, including 108, to stick to each other. One part of each hook-and-loop pad pair 108 is on side panel 106 and the other part is on the enclosure wall 104. Side-panel 106 is attached along its bottom edge to the enclosure 104 by two hinges, including 107, and is attached along its top edge to enclosure 104 by two separable hook-and-loop pad pairs, including 108. This attachment configuration allows the sleeper to exit the enclosure by simply pushing outwards on the top of side panel 106. This causes the hook-and-loop pads on enclosure wall 104 and side panel 106 to separate and the side panel 106 to tilt downwards.

In this example, opening 105 through which a sleeper enters or exits the enclosure is rectangular and the side panel 106 that covers it is rectangular and tilts downward to uncover the opening. In another example, the sleeping enclosure may have a circular horizontal cross-sectional shape. With a circular shape, the opening through which a sleeper enters or exits the enclosure may be curved and the side panel that covers it may be curved as well. In this latter example, the curved side panel may slide on circular tracks around the circle in order to open or close the opening.

FIG. 1 shows air conduits 109 and 110 that are part of an active means of ventilating sleeping enclosure 104. Air conduit 109 brings air coming from an external automated air moving means, such as an electric fan or air pump, that is not shown in the figure. There are many different types of fans and air pumps in the related art and the specific type of automated air moving means is not central to this invention. Thus, the automated air moving means is not shown in this figure.

Locating the automated air moving means some distance from the enclosure helps to reduce sound entering the enclosure in two ways. First, the distance reduces the sound generated by the automated air moving means that travels through the conduit to enter the sleeping enclosure. Second, the distance reduces the sound from environmental sources that travels through the conduit into the sleeping enclosure. It is also important to note that there is much less sound from environmental sources entering the enclosure through a relatively long conduit with an active ventilation means than would enter the enclosure through direct openings or screens in the enclosure wall. Accordingly, an active ventilation means can provide better insulation against environmental sounds than a passive ventilation means.

In FIG. 1, air inflow conduit 109 splits into two branches—air conduit 110 that brings fresh air into sleeping enclosure 104; and air conduit 111, which turns into conduit 112, that inflates the parallel arched longitudinal members, including 113, that form the ceiling of the enclosure. The purpose of this branching is to ensure that the only time that the longitudinal members forming the ceiling are inflated is when there is active air flow into the enclosure. If the active air flows stops, then the longitudinal members deflate and gaps between them allow passive ventilation. This linkage is a key ventilation safety feature of this invention. This linkage ensures that there is always one type of ventilation of the enclosure—there is either active ventilation through the automated air moving means sending air into the enclosure through conduit 109 or there is passive ventilation through the gaps between uninflated longitudinal members, including 113.

When the arched longitudinal members, including 113, are not inflated, there are large gaps between them, making the ceiling of the enclosure largely open to allow passive ventilation. When the arched longitudinal members, including 113, are inflated, then the gaps between them close and the ceiling becomes sound insulating. This configuration of air conduits (109, 110, 111, and 112) ensures that the longitudinal members (including 113) are only inflated when there is active ventilation of the enclosure. If for any reason the active airflow fails, then the longitudinal members deflate and passive ventilation occurs. In an optional add-on to this core invention, there may also be a third-level safety feature comprising a battery-powered alarm that monitors the air inside the enclosure and sounds an alarm in case of high CO2 level, low oxygen level, or some other indicator of unhealthy air.

In this example, the air conduits are configured so that the air entering conduit 111 and inflatable members, such as 113, has a higher pressure than the air within enclosure 104 when the automated air moving means is operating. In this example, air conduit 111 has a larger diameter than air conduit 110.

Roof peak rod 114, going across the peak of the arched ceiling, holds the longitudinal inflatable members up in an arched position. This is important so that these members: do not droop down into the enclosure when they are deflated; and so that they are relatively aligned, without gaps, when they are inflated.

FIG. 2 shows the same embodiment as shown in FIG. 1, but from a top-down perspective. This top-down view clearly shows the rafter-like configuration of the longitudinal arched inflatable members, including 113, that span the ceiling of the enclosure. In FIGS. 1 through 3, these members are uninflated, so there are large gaps between them. This allows passive ventilation of the enclosure. Subsequent figures will show what they look like when they are inflated. All of the components shown in FIG. 2 were first introduced in FIG. 1, except for outflow air conduit 201. Outflow air conduit 201 was obscured by inflow air conduit 109 in the side perspective of FIG. 1.

In different variations of this embodiment, the flow of air into the enclosure through conduit 109 and the flow of air out of the enclosure through conduit 201 may be set so that the air pressure within the enclosure is greater than, equal to, or less than that of the air pressure outside the enclosure. The main focus of this invention is on ensuring ventilation while providing sound insulation, not relative air pressure inside vs. outside the enclosure. Nonetheless, the ability to create a safely-ventilated higher-pressure sleeping environment may be very useful for some applications, such as treatment of sleep apnea without the need for a mask. It may even be possible to link the operation of this enclosure with clinical monitoring of a sleeper's breathing patterns; the enclosure could be programmed to close up and to increase internal atmospheric pressure in response to apnea-related breathing interruptions.

FIG. 3 shows this same embodiment from a rectangular-end perspective, looking at the end of the enclosure where the foot of the bed is located. All of the components shown in FIG. 3 were first introduced in FIG. 1 or 2. In this embodiment, air inflow conduit 109 and air outflow conduit 201 are both along the same end and located at approximately the mid-height of the box spring. In another example, these airflow conduits may be located at opposite ends of the enclosure to encourage greater circulation throughout the entire enclosure. However, having conduits at opposite ends may expose the person sleeping to more noise if noise enters the enclosure through the air flow conduit at the head of the bed.

Figure 4:
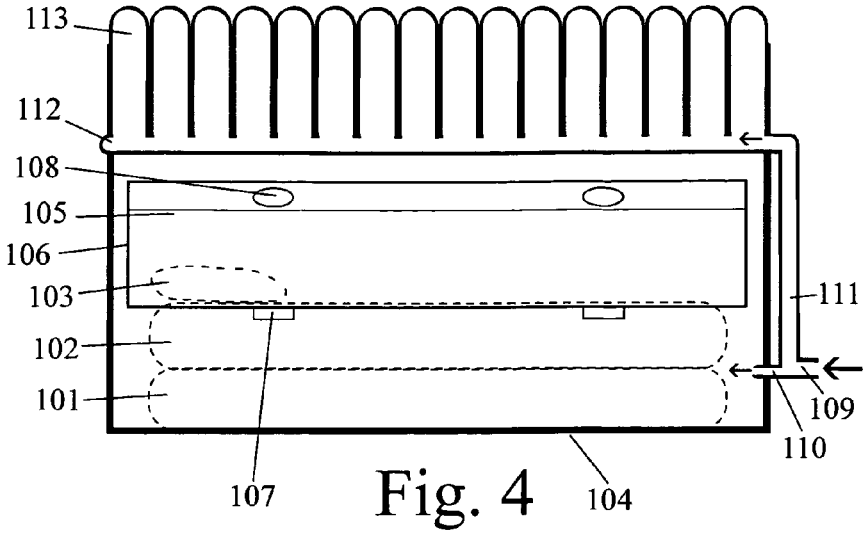
FIGS. 4 through 6 show side, top-down, and rectangular-end perspectives of this embodiment when the active ventilation system is operating, the inflatable members comprising the ceiling are inflated, and there are no gaps in the ceiling.
Figure 5:
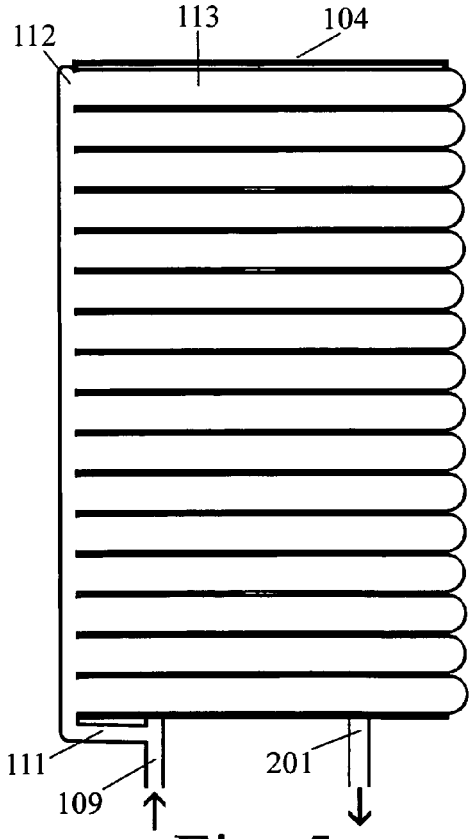
Figure 6:
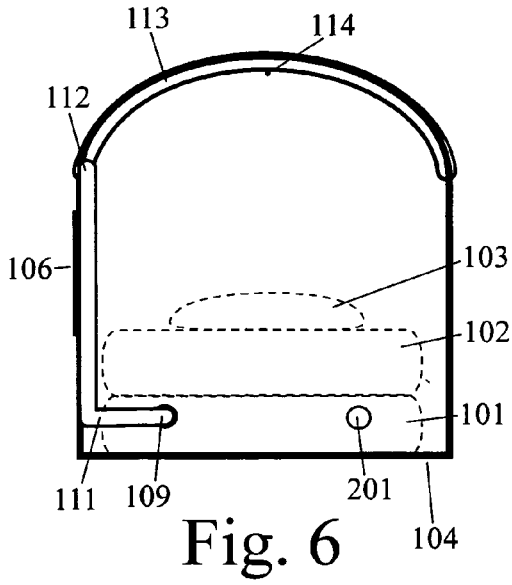

FIGS. 4 through 6 show the same three views (side, top-down, and rectangular-end perspectives) of the same embodiment of this invention that were shown in FIGS. 1 through 3, except that now the active ventilation system has been activated. Active ventilation inflates the longitudinal arched inflatable members spanning the ceiling, which closes the gaps between them. With the ceiling gaps closed, the sleeper becomes completely enclosed for maximum insulation from external sounds.

An arrow on the right side of FIG. 4 pointing into inflow air conduit 109 indicates that air is now flowing into conduit 109 from an automatic airflow source not shown in the figure. As mentioned previously, there are many different types of automatic airflow sources, including fans and pumps, in the related art and the exact specification of this airflow source is outside the central focus this invention. Thus, the automated airflow source is not shown in this figure.

The flow of air traveling into air conduit 109 branches into air conduit 111 and air conduit 110. The portion of the air flow that goes into air conduit 111 enters upper air conduit 112 and then inflates longitudinal arched members, including 113. When these arched members are all inflated, then the gaps between them are closed and they collectively create a continuous sound-insulating surface on the ceiling of the enclosure 104.

The portion of the air flow that goes into air inflow conduit 110 enters the sleeping enclosure to provide ventilation for the sleeping person. In this example, this airflow later exits the enclosure through air outflow conduit 201. Outflow conduit 201 was introduced in FIG. 3 and is shown again in FIG. 6. As mentioned earlier, the net balance between air inflow and outflow may be adjusted to create air pressure within the enclosure that is lower than, equal to, or greater than the air pressure outside the enclosure. Having low, equal, or high pressure in different examples of this invention may be advantageous for different applications. For example, a sleeping enclosure with higher pressure and ventilation assurance safeguards may be therapeutically innovative and useful for sleepers with sleep apnea.

Figure 7:
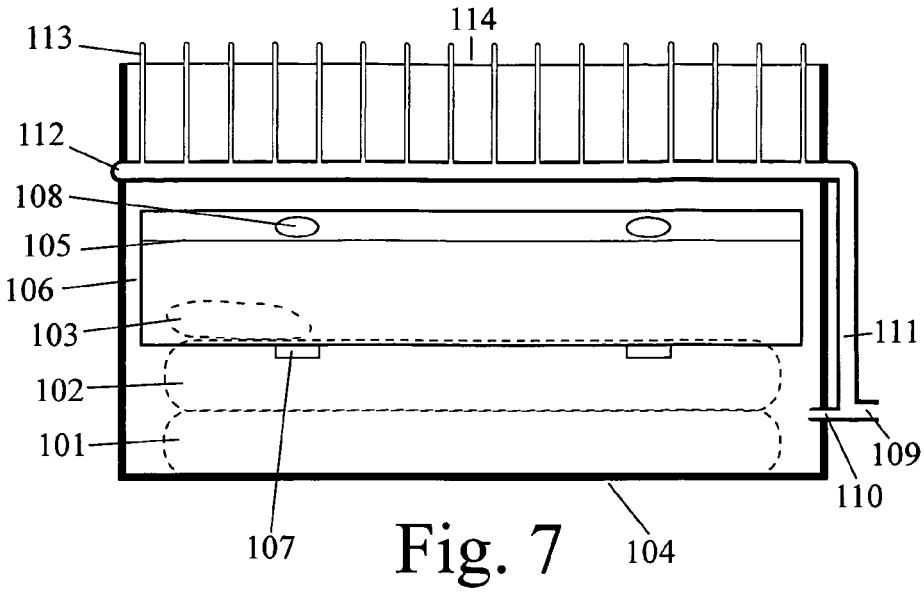
FIGS. 7 and 8 show details concerning one way in which a sleeper may enter or exit the enclosure.
Figure 8:
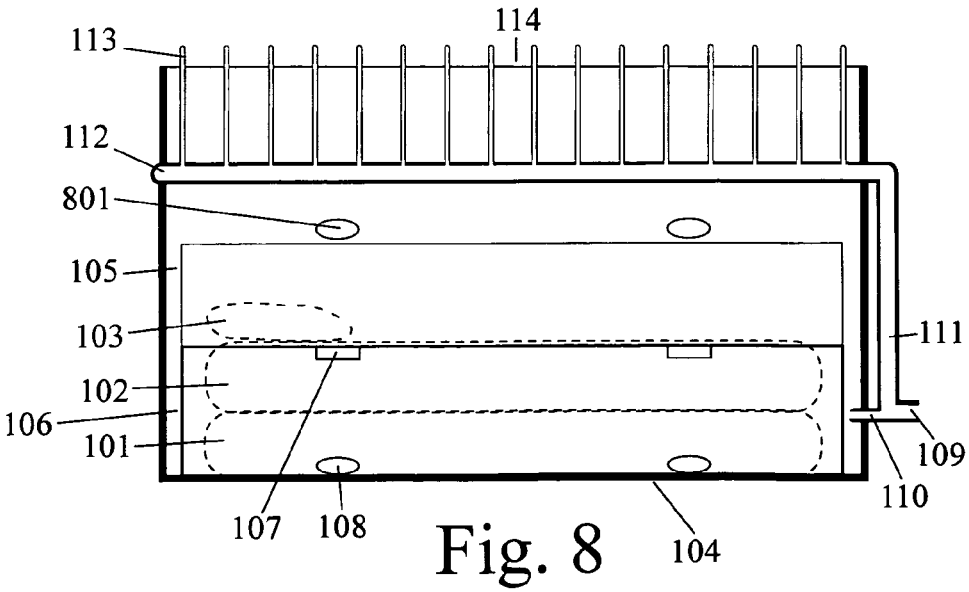

FIGS. 7 and 8 show details concerning one way in which a sleeper may enter or exit the enclosure. FIG. 7 shows rectangular moveable side panel 106 in an upward position where it covers rectangular hole 105 in enclosure wall 104. In this upward position, the lower edge of rectangular side panel 106 is attached to the enclosure with two hinges, including hinge 107, and the upper edge of the rectangular side panel 106 is attached to the enclosure with two loop-and-hook pads, including loop-and-hook pad 108. In this configuration, rectangular side panel 106 overlaps the enclosure and provides a sound-insulating seal.

FIG. 8 shows rectangular side panel 106 having been tilted downward, pivoting via the two hinges, including 107. This downward movement uncovers hole 105 in the enclosure wall 104 so that a sleeper can enter or exit the enclosure. This movement can be easily initiated from inside the enclosure by the sleeper simply pushing against the top of side panel 106. This pushing detaches the loop pad on the enclosure wall from the corresponding hook pad at the top of the rectangular panel. This causes the panel to move away from the enclosure and tilt downward. Such a method of easy and intuitive egress from the enclosure is important to avoid feelings of claustrophobia and to provide easy egress in case of an emergency.

The embodiment shown in FIGS. 1 through 8 focuses on the primary and innovative aspects of this invention in order to convey the invention clearly. There are, however, several useful options that one could add. For example, although the main focus of this invention is on assuring ventilation while providing insulation from external sound, options could be added that modify other characteristics of the environment within the sleeping enclosure. For example, options could be added that provide active sound production within the sleeping enclosure—such as active sound masking, soothing sounds, or music within the enclosure. In other examples, options could be added that modify light, temperature, air pressure, or air quality within the enclosure. For example, air filtering could be added to provide cleaner air within the enclosure than outside the enclosure.

In other examples, options may be added that provide selective communication with the external environment. For example, sound monitoring and analyzing means could be added to selectively transmit sounds that the sleeper wants to hear, such as external safety alarms, telephones, baby monitors, intercoms, or specific human voices. As an example, sophisticated voice recognition technology could identify and actively transmit voices from members of one's family, but could block out the voices of rowdy neighbors.

In other examples, operation of the active ventilation system may be designed to be affected by changes in the external environment. For example, the sleeper may live next door to a bar that plays bass-thumping music each night until some time between 1 am and 4 am. In this case, the invention might be optionally equipped with an external microphone and software algorithms to operate the active ventilation system and keep the ceiling closed until the algorithm detects silence for a given period of time. After a period of silence, the active ventilation system could shut off, the ceiling would open up, and passive ventilation would occur.

For example, when the sleeper goes to bed at 10 pm, the bar is hopping and bass-thumping music comes through the walls into the sleeper's bedroom. However, active ventilation is operating in the enclosure, the longitudinal members of the ceiling are inflated, and the sleeper is largely insulated from the thumping bass sounds. Thus, the sleeper can drift off to sleep in peace. Some time around 3 am the bar closes down. After around 15 minutes of continuous silence, the software algorithm shuts down operation of the active ventilation, the longitudinal members deflate, the ceiling opens up, and passive ventilation occurs. In this example, it is up to the sleeper whether they wish to set the invention to provide active ventilation and sound insulation all night long, or to only provide active ventilation and sound insulation when there is a certain type or level of external sound.

In another example, when the sleeper goes to bed at 10 pm, all is quiet and calm. The active ventilation system is not operating, the ceiling is open, and passive ventilation occurs. Then around 3 am the neighbor's crazy dog begins its nightly routine of incessant barking at the moon. The software detects the sound, turns on the active ventilation system, the gaps in the ceiling are closed, and the sleeping enclosure becomes fully insulated against the canine cacophony.

It is worthwhile to again highlight the safety aspects of this invention in case of an external power failure, battery failure, motor failure, or any other failure that stops the active ventilation. This invention is designed so that a means of passive ventilation is assured if the active ventilation system stops for any reason. In this example, the default position of the longitudinal inflatable members spanning the ceiling of the enclosure is a deflated position, allowing ample passive ventilation for the enclosure. The only way that the longitudinal inflatable members expand to seal off the enclosure from both sound and passive ventilation is by airflow from operation of the active ventilation system. Having said this, for even greater safety, a tertiary safety feature such as a battery operated high CO2 or low oxygen alarm may also be added to the enclosure.

I claim:

1. A sound-insulating sleeping enclosure with ventilation safeguards comprising:

a sound-insulating sleeping enclosure, within which one or more people sleep, that reduces exposure of one or more sleepers to sounds;

a first ventilation means for ventilation wherein this first means for ventilation provides active ventilation of the sleeping enclosure when this first ventilation means for ventilation is operating;

a second ventilations means for ventilation wherein this second means for ventilation provides passive ventilation of the sleeping enclosure whenever the first means for ventilation is not operating; and an automatic linkage between the operation of the first means for ventilation and the second means for ventilation that ensures either active ventilation of the enclosure through the first means for ventilation or passive ventilation of the enclosure through the second means for ventilation such that uninterrupted continued operation of the first ventilation means prevents uninterrupted continued operation of the second ventilation means, and uninterrupted continued operation of the second ventilation means can only occur when the first ventilation means is not operating;

wherein the second ventilation means for ventilation comprises a plurality of parallel inflatable members fluidly interconnected at one of their respective ends, wherein, when inflated, the inflatable members cooperate to close gaps between adjacent inflatable members.

2. The sound-insulating sleeping enclosure in claim 1 wherein the first means for ventilation includes members selected from the group consisting of: an electric fan, an air pump, and other automated devices for moving air.

3. The sound-insulating sleeping enclosure in claim 1 wherein ventilation by operation of the first means for ventilation results in lower exposure of sleepers to sounds from outside the enclosure than does ventilation by the second means for ventilation.

4. The sound-insulating sleeping enclosure in claim 1 wherein a battery-operated alarm is added within the enclosure to warn sleepers of high carbon dioxide, low oxygen, or other unhealthy air parameters within the enclosure, as a tertiary safety measure.

5. The sound-insulating sleeping enclosure in claim 1 wherein operation of the first means for ventilation is controlled by a mechanism that monitors sounds outside the enclosure, such that the first means for ventilation operates until the exterior sound level drops below a certain level for a certain period of time.

6. The sound-insulating sleeping enclosure in claim 1 wherein an added mechanism monitors sounds outside the enclosure to identify and selectively transmit certain sounds that the sleeper wants to hear.

7. The sound-insulating sleeping enclosure in claim 1 wherein characteristics of the environment within the enclosure that may be adjusted are selected from the group consisting of light level, light patterns, temperature level, humidity level, active noise masking, and soothing sounds or music.

8. The sound-insulating sleeping enclosure in claim 1 wherein the sound-insulating enclosure is large enough for two sleepers and contains a movable divider that can optionally divide the airspace between the two sleepers to provide two separate sound environments.

9. The sound-insulating sleeping enclosure in claim 1 wherein the air pressure within the sleeping enclosure is higher than the air pressure outside the sleeping enclosure as an aid in treating Obstructive Sleep Apnea (OSA).

10. A sound-insulating sleeping enclosure with ventilation safeguards comprising:

a sound-insulating sleeping enclosure, within which one or more people sleep, that reduces exposure of one or more sleepers within the enclosure to sounds from outside the enclosure;

a first ventilation means for ventilation wherein this first means for ventilation provides active ventilation of the sleeping enclosure when this first means for ventilation is operating;

a second means for ventilation wherein this second means for ventilation provides passive ventilation of the sleeping enclosure whenever the first means for ventilation is not operating; wherein this second means for ventilation does not provide ventilation of the sleeping enclosure when the first means for ventilation is operating; The first means for ventilation results in lower exposure of sleepers to sounds from outside the enclosure than does ventilation by the second means for ventilation; and an automatic linkage between the operation of the first means for ventilation and the second means for ventilation that ensures either active ventilation of the enclosure through the first means for ventilation or passive ventilation of the enclosure through the second means for ventilation, such that uninterrupted continued operation of the first ventilation means prevents uninterrupted continued operation of the second ventilation means, and uninterrupted continued operation of the second ventilation means can only occur when the first ventilation means is not operating;

wherein the second ventilation means for ventilation comprises a plurality of parallel inflatable members fluidly interconnected at one of their respective ends, wherein, when inflated, the inflatable members cooperate to close gaps between adjacent inflatable members.

11. The sound-insulating sleeping enclosure in claim 10 wherein a battery-operated alarm is added within the enclosure to warn sleepers of high carbon dioxide, low oxygen, or other unhealthy air parameters within the enclosure, as a tertiary safety measure.

12. The sound-insulating sleeping enclosure in claim 10 wherein operation of the first means for ventilation is controlled by a mechanism that monitors sounds outside the enclosure, such that the first means for ventilation operates until the exterior sound level drops below a certain level for a certain period of time.

13. The sound-insulating sleeping enclosure in claim 10 wherein an added mechanism monitors sounds outside the enclosure to identify and selectively transmit certain sounds that the sleeper wants to hear.

14. The sound-insulating sleeping enclosure in claim 10 wherein characteristics of the environment within the enclosure that may be adjusted are selected from the group consisting of light level, light patterns, temperature level, humidity level, active noise masking, and soothing sounds or music.

15. The sound-insulating sleeping enclosure in claim 10 wherein the sound-insulating enclosure is large enough for two sleepers and contains a movable divider that can optionally divide the airspace between the two sleepers to provide two separate sound environments.

16. The sound-insulating sleeping enclosure in claim 10 wherein the air pressure within the sleeping enclosure is higher than the air pressure outside the sleeping enclosure as an aid in treating Obstructive Sleep Apnea (OSA).

* * * * *